US006880740B2

(12) United States Patent
Lu

(10) Patent No.: US 6,880,740 B2
(45) Date of Patent: Apr. 19, 2005

(54) IMPACT ENHANCING DEVICE OF AN ELECTRIC NAILER

(75) Inventor: Chao-Cheng Lu, No. 4-4, Alley 27, Lane 143, Jiungung Rd., Taipei (TW)

(73) Assignees: Chao-Cheng Lu, Taipei (TW); Hung-Fei Chen, Taichung (TW)

( * ) Notice: Subject to any disclaimer, the term of this patent is extended or adjusted under 35 U.S.C. 154(b) by 0 days.

(21) Appl. No.: 10/326,684

(22) Filed: Dec. 20, 2002

(65) Prior Publication Data

US 2003/0116601 A1 Jun. 26, 2003

(30) Foreign Application Priority Data

Dec. 24, 2001 (TW) ..... 90131968 A

(51) Int. Cl.[7] ..... B25C 5/15
(52) U.S. Cl. ..... 227/131
(58) Field of Search ..... 227/120, 129, 227/134, 139, 131; 310/68 R; 363/44, 47, 48, 50, 52, 53, 54, 84, 85

(56) References Cited

U.S. PATENT DOCUMENTS 3,267,337 A * 8/1966 Doyle et al. ..... 361/153
3,589,587 A * 6/1971 Manganaro ..... 227/131
3,662,190 A * 5/1972 Naber ..... 327/129
3,673,475 A * 6/1972 Britton, Jr. ..... 318/122
4,012,675 A * 3/1977 Schulze, Jr. ..... 318/37
4,212,054 A * 7/1980 Seki ..... 363/53
4,293,088 A * 10/1981 Barrett et al. ..... 227/131
4,300,282 A * 11/1981 Bunyea et al. ..... 29/751
4,349,143 A * 9/1982 Ewig ..... 227/131
4,492,880 A * 1/1985 Weiss ..... 327/402
4,500,938 A * 2/1985 Dulin ..... 361/153
4,558,391 A * 12/1985 Ward et al. ..... 361/155
4,747,455 A * 5/1988 Cunningham ..... 173/1
4,770,335 A * 9/1988 Wingert ..... 227/139
5,114,442 A * 5/1992 Artz ..... 96/19
5,491,624 A * 2/1996 Levran et al. ..... 363/87
5,592,367 A * 1/1997 Sugimori et al. ..... 363/17
5,666,715 A * 9/1997 Zoiss et al. ..... 29/566.4

* cited by examiner

*Primary Examiner*—Eugene Kim
*Assistant Examiner*—Paul Durand
(74) *Attorney, Agent, or Firm*—Charles E. Baxley

(57) ABSTRACT

An impact enhancing device of an electric nailer, comprising: an AC power source, a protection circuit, a first switch, a full-wave rectifier, a timing controller circuit, an energy-storage circuit, a solid-state switch circuit, an electromagnetic coil device, a DC power source, a second switch, a reset enable single shot trigger circuit, and a relay. Thus, the electric nailer provides a larger impact force with a smaller volume and a lighter weight.

6 Claims, 5 Drawing Sheets

IMPACT ENHANCING DEVICE OF AN ELECTRIC NAILER

BACKGROUND OF THE INVENTION

The present invention relates to an impact enhancing device of an electric nailer, and more particularly to an impact enhancing device of an electric nailer, wherein the electric nailer provides a larger impact force with a smaller volume and a lighter weight.

SUMMARY OF THE INVENTION

The present invention has arisen to mitigate and/or obviate the disadvantage of the conventional electric nailer.

The primary objective of the present invention is to provide an electric nailer containing an impact enhancing device, wherein the electric power stored in the energy-storage capacitor of the energy-storage circuit discharges to the electro-magnetic coil of the electro-magnetic coil device in a short period of time, thereby obtaining the maximum and optimum impact force.

In accordance with one aspect of the present invention, there is provided an electric nailer having an impact enhancing device, comprising: an alternating current power source, a protection circuit, a first switch, a full-wave/multiplying rectifier, a timing controller circuit, an energy-storage circuit, a solid-state switch circuit, an electro-magnetic coil device, a direct current power source, a second switch, a reset enabling single shot trigger circuit, and a relay.

Preferably, the full-wave doubler includes two diodes and two electrolytic capacitors, so as to obtain a direct current voltage that is two times of an alternating current voltage.

Preferably, the full-wave tripler includes three diodes and three electrolytic capacitors, so as to obtain a direct current voltage that is three times of an alternating current voltage.

Preferably, the timing controller circuit contains a timing controller resistor connected to an output terminal of the full-wave rectifier in a coupling manner.

Preferably, the energy-storage circuit contains an energy-storage capacitor connected to one side of a normally closed connector of the relay in a coupling manner and connected to one port of an electro-magnetic coil of the electro-magnetic coil device in a coupling manner.

Preferably, the electro-magnetic coil device includes an electro-magnetic coil and an impact stroke device, the electro-magnetic coil of the electro-magnetic coil device contains a first port connected to the anode of a silicon controller rectifier (SCR) of the solid-state switch circuit and a second port connected to the positive terminal of an energy-storage capacitor of the energy-storage circuit and to one side of a normally closed connector of the relay, the energy-storage capacitor of the energy-storage circuit contains a negative terminal connected to the cathode of the SCR of the solid-state switch circuit, wherein:

when the SCR of the solid-state switch circuit is conducted, the electro-magnetic coil generates an electro-magnetic force, so that the impact device generates an impact force because of magnetism.

Preferably, the solid-state switch circuit includes a SCR and two voltage divider resistors, the SCR contains an anode connected to one port of an electro-magnetic coil of the electro-magnetic coil device and a cathode connected to the negative terminal of an energy-storage capacitor of the energy-storage circuit, each of the two voltage divider resistors contains a first port connected to a normally opened connector of the relay and a second port connected to the gate of the SCR, wherein:

when the two voltage divider resistors are subjected to a voltage, the SCR is conducted, so that the energy-storage capacitor of the energy-storage circuit discharges a current to pass through the electro-magnetic coil of the electro-magnetic coil device, thereby producing an electro-magnetic force.

Preferably, the SCR can be replaced by a Triac thyristor, MOSFET (Metal-Oxide Semiconductor Field Effect Transistor), IGBT (Insulated Gate Bipolar Transistor), or other solid-state switch device.

Preferably, the relay includes an electro-magnetic coil, a normally closed connector and a normally opened connector, the electro-magnetic coil contains a first port connected to the collector of a transistor of the reset enable single shot trigger circuit and a second port connected to the positive terminal of the direct current (DC) power source, the normally closed connector contains a first port connected to the positive terminal of an energy-storage capacitor of the energy-storage circuit and to one port of an electro-magnetic coil of the electro-magnetic coil device and a second port connected to the positive terminal of the full-wave rectifier is a full-wave tripler, and the normally opened connector contains a first port connected to the first port of the normally closed connector, to the positive terminal of the energy-storage capacitor of the energy-storage circuit and to the one port of the electro-magnetic coil of the electro-magnetic coil device and a second port connected to one port of a voltage divider resistor of the solid-state switch circuit, wherein:

the relay circuit conducts the energy-storage capacitor of the energy-storage circuit and supplies an electric power to the voltage divider resistor of the solid-state switch circuit.

Preferably, the reset enable single shot trigger circuit includes two state changing resistors, a timing controller capacitor, a timing controller resistor, two voltage divider resistors, a transistor, and a timing controller module circuit, wherein:

the timing controller module circuit outputs an impulse to the base of the transistor so that the electro-magnetic coil of the relay operates.

Preferably, the direct current power source includes a voltage drop resistor, a zener diode and a filtering capacitor, the voltage drop resistor contains one port connected to an output positive terminal of the full-wave rectifier, wherein:

the DC power source supplies a DC voltage to the reset enable single shot trigger circuit and the electro-magnetic coil of the relay.

In accordance with another aspect of the present invention, there is provided a circuit device for inverting a DC power source into an alternating current (AC) power source, comprising:

a photo coupler module circuit including a light emitting diode containing a first port connected to a first port of a current limited resistor and a second port connected to the grounding port of the reset enable single shot trigger circuit, the current limited resistor contains a second port connected to an impulse output terminal of a timing controller module circuit, wherein the photo coupler module circuit transfers an impulse signal; and a relay circuit including an electro-magnetic coil, a normally closed connector, a normally opened connector, a transistor, and a base resistor, wherein the electro-magnetic coil contains a first port connected to the positive terminal of a DC power supply and a second port connected to the collector of the transistor, the emitter of the transistor is grounding, the base of the transistor is connected to the base resistor and to a first port of the output port of the photo coupler module circuit, the output port of the photo coupler module circuit contains a second port connected to the first port of the current limited resistor, the normally closed connector contains a first port connected to a first port of a first switch of the DC power supply and a second port connected to the positive supply terminal of an oscillation circuit, the first switch of the DC power supply contains a second port connected to the positive terminal of the DC power supply, so that when the output port of the photo coupler module circuit is conducted, the oscillation circuit stops operation, and when the output port of the photo coupler module circuit is shutoff, the oscillation circuit starts operating.

Further benefits and advantages of the present invention will become apparent after a careful reading of the detailed description with appropriate reference to the accompanying drawings.

DETAILED DESCRIPTION OF THE INVENTION

Figure 1:
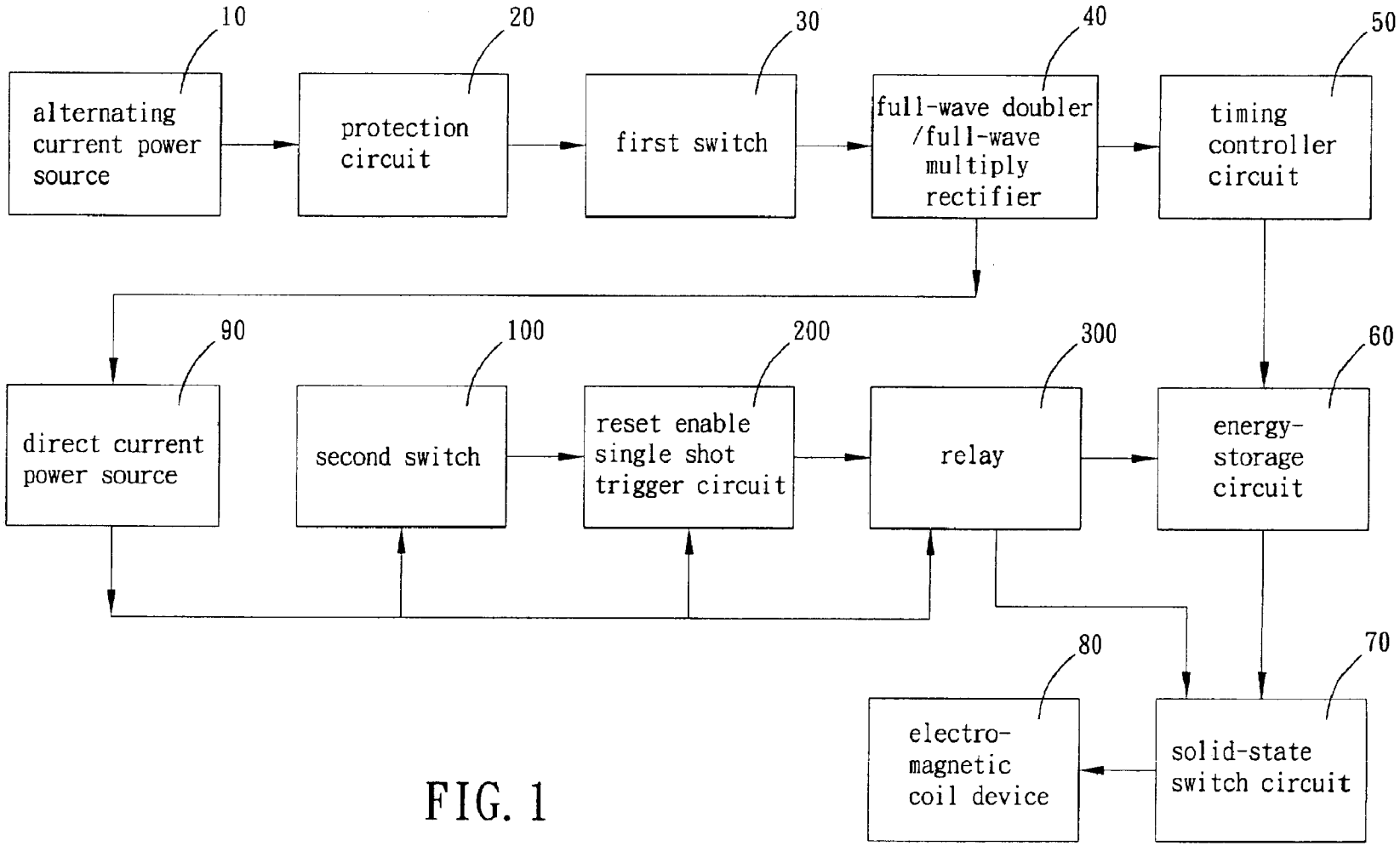
FIG. 1 is a block view of an impact enhancing device of an electric nailer in accordance with a first embodiment of the present invention.
Figure 2:
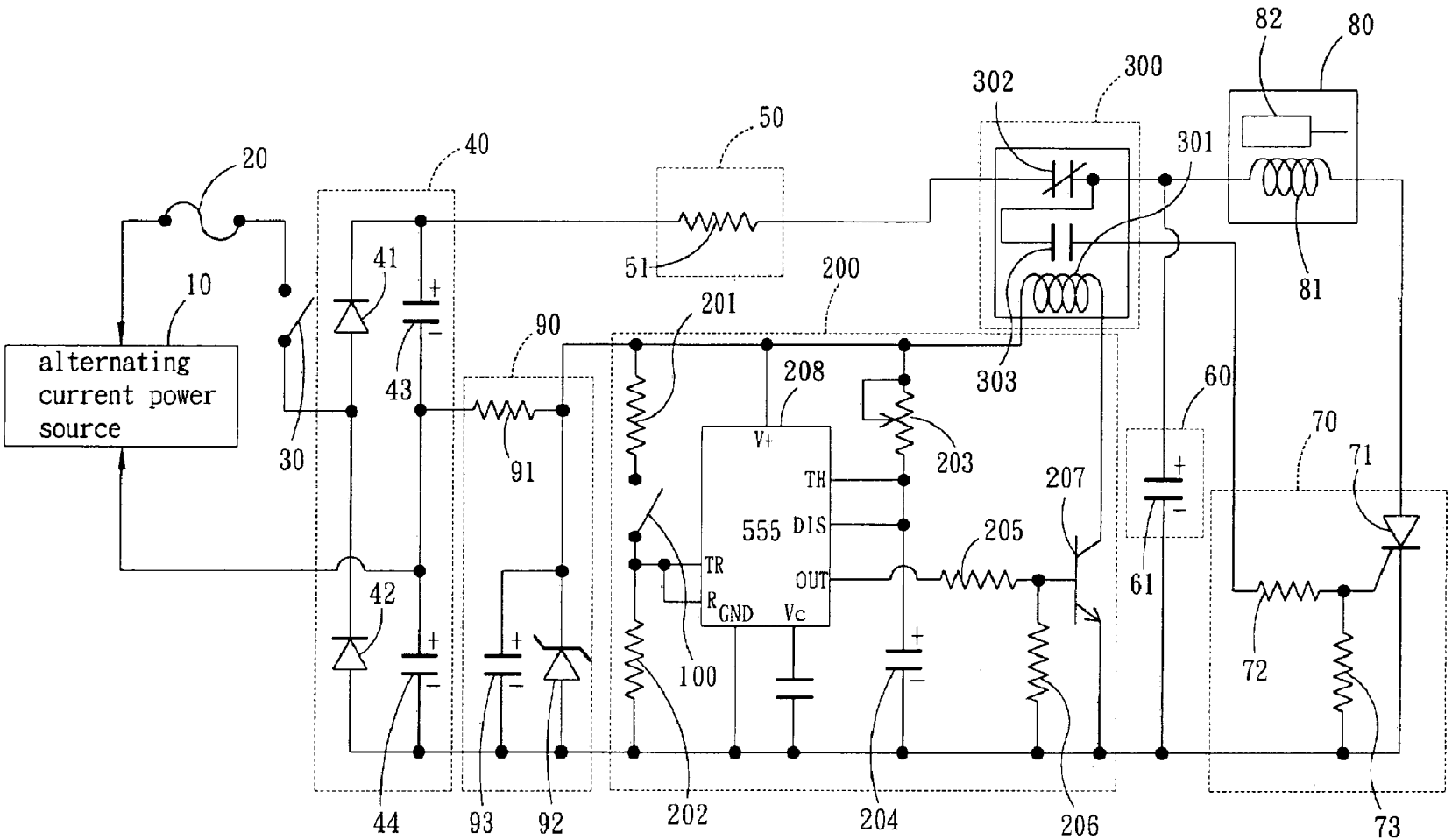
FIG. 2 is a circuit diagram of the impact enhancing device of the electric nailer in accordance with the first embodiment of the present invention.

Referring to the drawings and initially to FIGS. 1 and 2, an impact enhancing device of an electric nailer in accordance with a first embodiment of the present invention comprises an alternating current power source 10, a protection circuit 20, a first switch 30, a full-wave doubler/full-wave rectifier 40, a timing controller circuit 50, an energy-storage circuit 60, a solid-state switch circuit 70, an electro-magnetic coil device 80, a DC power source 90, a second switch 100, a reset enable single shot trigger circuit 200, and a relay 300.

When the first switch 30 is disposed at the "ON" state, the alternating current passes through the protection circuit 20 and the first switch 30 to the full-wave doubler 40. The full-wave doubler 40 includes two diodes 41 and 42 and two electrolytic capacitors 43 and 44. The negative terminal of the electrolytic capacitor 43 is connected to the positive terminal of the electrolytic capacitor 44 at a first terminal of the AC power source 10. The P junction of the diode 41 is connected to the N junction of the diode 42 at a second terminal of the alternating current power source 10. The N junction of the diode 41 is connected to the positive terminal of the electrolytic capacitor 43 to form the positive output terminal of the full-wave doubler 40. The P junction of the diode 42 is connected to the negative terminal of the electrolytic capacitor 44 to form the negative output terminal of the full-wave doubler 40.

The current from the positive output terminal of the full-wave doubler 40 passes through the timing controller resistor 51 of the timing controller circuit 50, the normally closed connector 302 of the relay 300 and flows into the energy-storage capacitor 61 of the energy-storage circuit 60 to perform a charging process. At this time, the DC from the positive terminal of the electrolytic capacitor 44 flows into the voltage drop resistor 91 of the DC power source 90 and passes through the N junction of the zener diode 92 and the positive terminal of the filtering capacitor 93 of the DC power source 90.

At this time, the N junction of the zener diode 92 supplies a DC voltage to the reset enable single shot trigger circuit 200. The reset enable single shot trigger circuit 200 includes a second switch 100, two state changing resistors 201 and 202, a timing controller capacitor 204 for outputting the pulse, a timing controller resistor 203, a pulse output circuit containing two voltage divider resistors 205 and 206, a transistor 207, and a timing controller module circuit 208. When the second switch 100 is disposed at the "ON" state, a pulse voltage exists in the pulse output circuit. The period of the pulse voltage is T=KRC, wherein K is a constant depending on the timing controller module circuit, R is the value of the timing controller resistor, and C is the value of the timing controller capacitor.

At this time, the transistor 207 is disposed at the "ON" state. Thus, the electro-magnetic coil 301 is energized, so that the normally opened connector 303 of the relay 300 is disposed at the "ON" state. At this time, the gate of the silicon controller rectifier (SCR) 71 of the solid-state switch circuit 70 is subjected to the mid-point voltage of the two voltage divider resistors 72 and 73 of the solid-state switch circuit 70 to turn into the "ON" state. At this time, the energy-storage capacitor 61 of the energy-storage circuit 60 discharges toward the electro-magnetic coil 81 of the electro-magnetic coil device 80.

Thus, the electric power of the electro-magnetic coil 81 of the electro-magnetic coil device 80 is $P=CV^2/t$, wherein C is the value (the unit of C is Farad, F) of the energy-storage capacitor 61 of the energy-storage circuit 60, V is the voltage of the DC (the unit of V is Volt), and t is the time (the unit of t is second). Thus, the required electro-magnetic force is obtained by using a proper energy-storage capacitor 61 of the energy-storage circuit 60. When the electro-magnetic coil 81 of the electro-magnetic coil device 80 is energized, the impact stroke device 82 of the electro-magnetic coil device 80 is operated. The impact stroke device 82 of the electro-magnetic coil device 80 is magnetized by the electro-magnetic coil device 80 and moving toward the electro-magnetic coil device 80 in high speed, so as to eject the nail outward.

Figure 3:
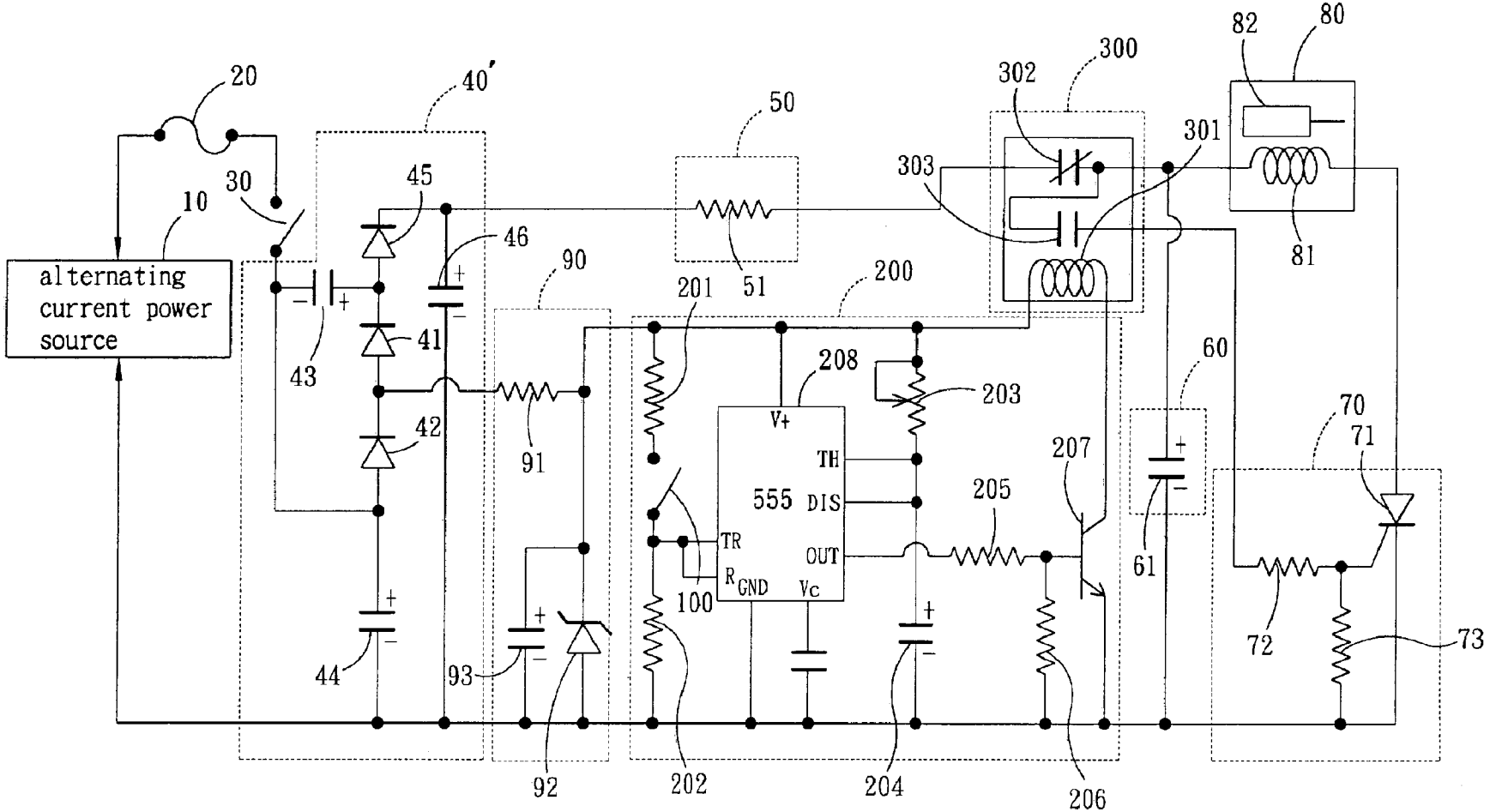
FIG. 3 is a circuit diagram of the impact enhancing device of the electric nailer in accordance with the second embodiment of the present invention.

Referring to FIG. 3, in accordance with a second embodiment of the present invention, the full-wave tripler 40 includes three diodes 41, 42 and 45 and three electrolytic capacitors 43, 44 and 46. Thus, the voltage of the two ports of the electrolytic capacitor 46 is three times of the DC voltage of the AC power source, and is supplied into the energy-storage capacitor 61 of the energy-storage circuit 60 to perform a charging process. According to the formula of $P=CV^2/t$, when the voltage V of the two ports of the energy-storage capacitor 61 of the energy-storage circuit 60 is increased, the capacitance C is increased, so that the electric power P of the electro-magnetic coil 81 of the electro-magnetic coil device 80 is increased, the magnetized energy is increased as well.

Figure 4:
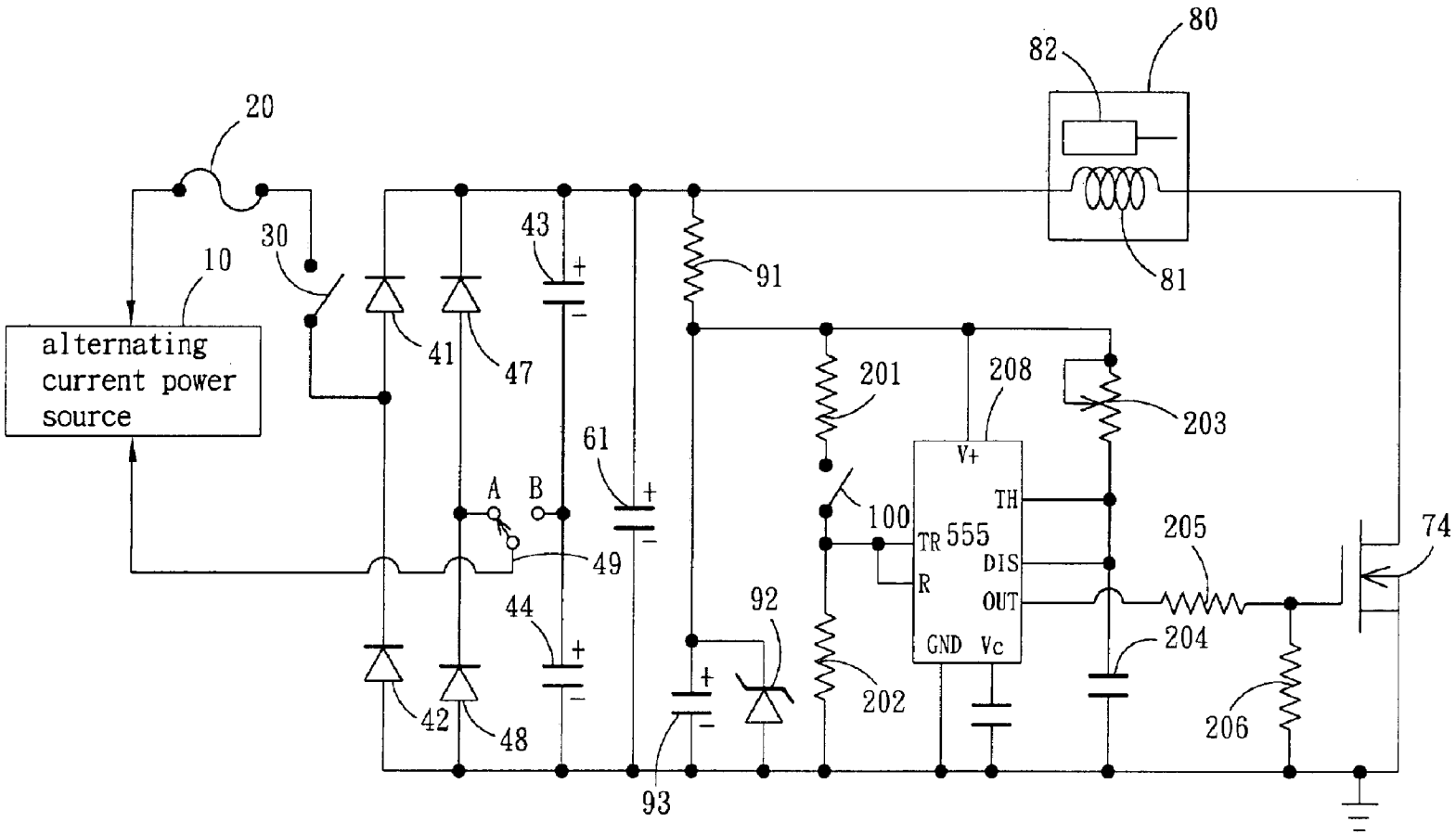
FIG. 4 is a circuit diagram of the impact enhancing device of the electric nailer in accordance with the third embodiment of the present invention.

Referring to FIG. 4, in accordance with a third embodiment of the present invention, when the AC power source 10 has different values, such as AC-110V or AC-220V, the impact enhancing device of the electric nailer in accordance with the present invention further comprises a switch 49. Thus, when the switch 49 is directed toward the junction "A", the AC power source 10 supplies a voltage of 220V. Alternatively, when the switch 49 is directed toward the junction "B", the AC power source 10 supplies a voltage of 110V. In addition, the output impulse of the reset enable single shot trigger circuit 200 is supplied to the gate the MOSFETS 74 of the solid-state switch circuit 70. That is, the SCR 71 of the solid-state switch circuit 70 can be replaced by the MOSFETS 74, the IGBT, or other solid-state switch device, and the relay 300 is omitted. Thus, the electric power P of the electro-magnetic coil 81 of the electro-magnetic coil device 80 is controlled by the period of the output impulse.

Figure 5:
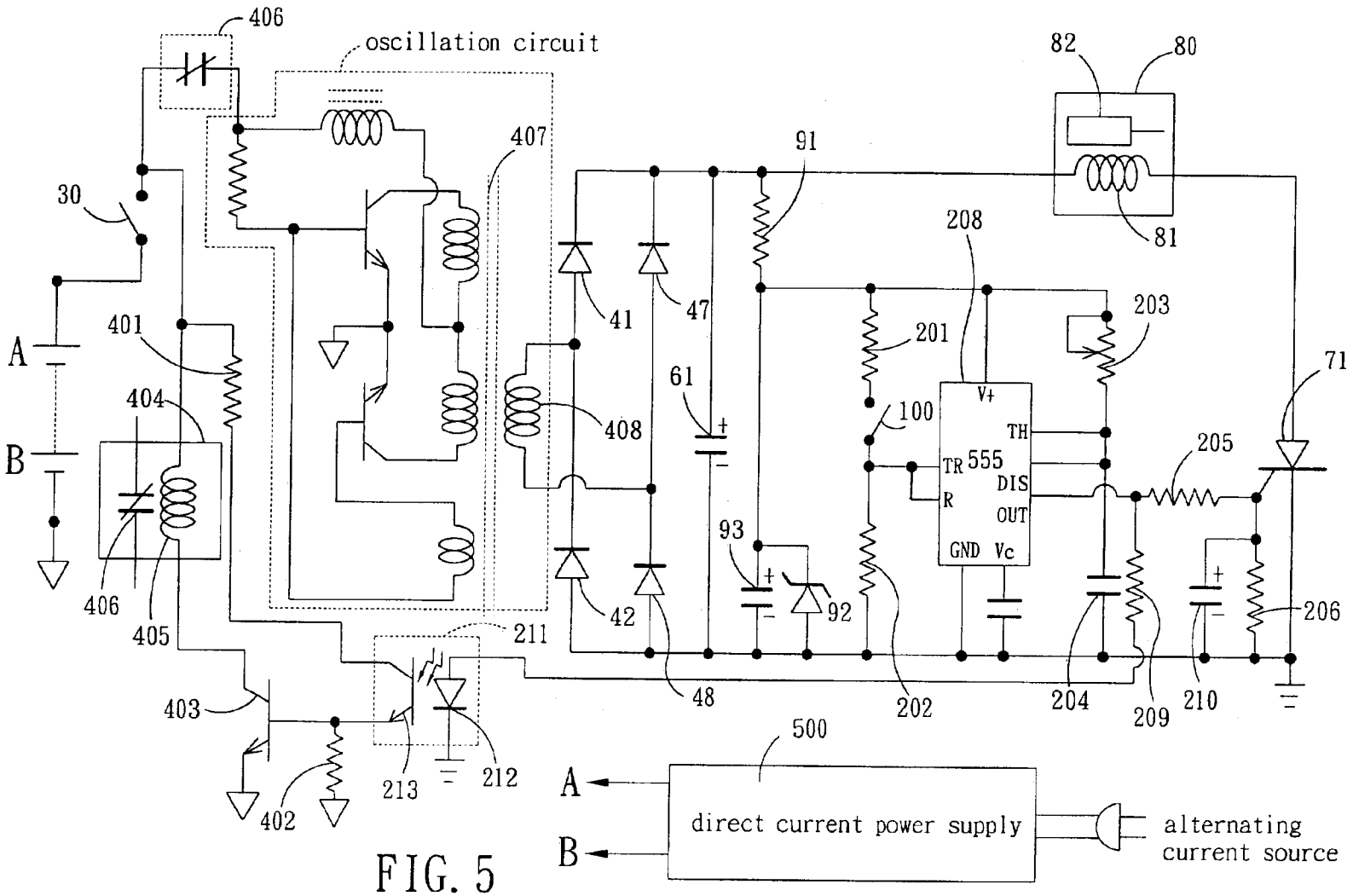
FIG. 5 is a circuit diagram of the impact enhancing device of the electric nailer in accordance with the fourth embodiment of the present invention.

Referring to FIG. 5, in accordance with a fourth embodiment of the present invention, the voltage of the DC power supply 500 is inverted through an inverter circuit 400 into a high frequency AC voltage which flows into the secondary 408 of the high frequency transformer 407, and is then rectified by the full-wave rectifier 40, and the electric power is stored at the two ports of the energy-storage capacitor 61 of the energy-storage circuit 60 to perform a charging process. At this time, if the second switch 100 is disposed at the "ON" state, the reset enable single shot trigger circuit 200 outputs an impulse which passes through the gate of the SCR 71 of the solid-state switch circuit 70, the current limited resistor 209, and flows into the light emitting diode 212 of the photo coupler module circuit 211. At this time, the output side 213 of the photo coupler module circuit 211 is conducted, and the two ports of the base resistor 402 of the transistor 403 is subjected to the voltage, so that the transistor 403 is conducted, and the electro-magnetic coil 405 of the relay 404 is energized, so that the normally closed connector 406 of the relay 404 is disposed at the "OFF" state. At the same time, the SCR 71 of the solid-state switch circuit 70 is turned into the "ON" state. Thus, the electro-magnetic coil 81 of the electro-magnetic coil device 80 is energized to generate the electro-magnetic power, so that the impact device 82 of the electro-magnetic coil device 80 is operated, so as to eject the nail outward. At this time, the light emitting diode 212 of the photo coupler module circuit 211 does not emit light, so that the electro-magnetic force of the electro-magnetic coil 405 of the relay 404 disappears, and the normally closed connector 406 of the relay 404 is disposed at the "ON" (or closed) state.

While the preferred embodiment(s) of the present invention has been shown and described, it will be apparent to those skilled in the art that various modifications may be made in the embodiment(s) without departing from the spirit of the present invention. Such modifications are all within the scope of the present invention.

What is claimed is:

1. An impact enhancing device of an electric nailer, comprising: an AC power source, a protection circuit, a first switch, a full-wave rectifier/full-wave doubler, a timing controller circuit, an energy-storage circuit, a solid-state switch circuit, an electro-magnetic coil device, a DC power source, a second switch, a reset enable single shot trigger circuit, and a relay;

wherein the solid-state switch circuit includes a SCR and two voltage divider resistors, the SCR contains an anode connected to one port of an electro-magnetic coil of the electro-magnetic coil device and a cathode connected to the negative terminal of an energy-storage capacitor of the energy-storage circuit, each of the two voltage divider resistors contains a first port connected to a normally opened connector of the relay and a second port connected to the gate of the SCR, wherein:

when the two voltage divider resistors are subjected to a voltage, the SCR is conducted, so that the energy-storage capacitor of the energy-storage circuit discharges to the electro-magnetic coil of the electro-magnetic coil device, thereby generating an electro-magnetic force.

2. The impact enhancing device of the electric nailer in accordance with claim 1, wherein the SCR can be replaced by a Triac thyristor, MOSFET, IGBT, and other solid-state switch device.

3. The impact enhancing device of the electric nailer in accordance with claim 1, wherein the relay includes an electro-magnetic coil, a normally closed connector and a normally opened connector, the electro-magnetic coil contains a first port connected to the collector of a transistor of the reset enable single shot trigger circuit and a second port connected to the positive terminal of the DC power source, the normally closed connector contains a first port connected to the positive terminal of an energy-storage capacitor of the energy-storage circuit and to one port of an electro-magnetic coil of the electro-magnetic coil device and a second port connected to the positive terminal of the full-wave rectifier is a full-wave tripler, and the normally opened connector contains a first port connected to the first port of the normally closed connector, to the positive terminal of the energy-storage capacitor of the energy-storage circuit and to the one port of the electro-magnetic coil of the electro-magnetic coil device and a second port connected to one port of a voltage divider resistor of the solid-state switch circuit, wherein:

the relay conducts the energy-storage capacitor of the energy-storage circuit and supplies an electric power to the voltage divider resistor of the solid-state switch circuit.

4. The impact enhancing device of the electric nailer in accordance with claim 3, the relay circuit can be replaced by other programmable, controllable solid-state switch acts the same function as relay.

5. The impact enhancing device of the electric nailer in accordance with claim 1, wherein the reset enable single shot trigger circuit includes two state changing resistors, a timing controller capacitor, a timing controller resistor, two voltage divider resistors, a transistor, and a timing controller module circuit, wherein:

the timing controller module circuit outputs an impulse to the base of the transistor so that the electro-magnetic coil of the relay operates, the timing controller module can be all types of timer IC, micro processor, and analog device combinations.

6. The impact enhancing device of the electric nailer in accordance with claim 1, wherein the DC power source includes a voltage drop resistor, a zener diode and a filtering capacitor, the voltage drop resistor contains one port connected to an output positive terminal of the full-wave rectifier, wherein:

the DC power source supplies a DC to the reset enable single shot trigger circuit and the electro-magnetic coil of the relay.

* * * * *